US006126394A

United States Patent [19]

Matsuda

[11] Patent Number: 6,126,394

[45] Date of Patent: Oct. 3, 2000

[54] TURBINE NOZZLE AND MOVING BLADE OF AXIAL-FLOW TURBINE

[75] Inventor: Minoru Matsuda, Yokohama, Japan

[73] Assignee: Kabushiki Kaisha Toshiba, Kawasaki, Japan

[21] Appl. No.: 08/999,260

[22] Filed: Dec. 29, 1997

[30] Foreign Application Priority Data

Dec. 27, 1996 [JP] Japan ..... 8-350960

[51] Int. Cl.[7] ..... F01D 9/02

[52] U.S. Cl. ..... 415/192; 415/210.1

[58] Field of Search ..... 415/191, 192, 415/208.2, 208.1, 210.1, 209.2, 209.3, 209.4, 914

[56] References Cited

U.S. PATENT DOCUMENTS

| | | | |
|---|---|---|---|
| 4,741,667 | 5/1988 | Price et al. | 415/191 |
| 4,778,338 | 10/1988 | Bessay | 415/181 |
| 5,706,647 | 1/1998 | Frey et al. | 60/39.75 |
| 5,716,192 | 2/1998 | Phillips et al. | 415/115 |

FOREIGN PATENT DOCUMENTS

| | | |
|---|---|---|
| 5-069301 | 9/1993 | Japan . |
| 6-081603 | 3/1994 | Japan . |
| 8-218803 | 8/1996 | Japan . |

*Primary Examiner*—Edward K. Look
*Assistant Examiner*—Rhonda Barton
*Attorney, Agent, or Firm*—Oblon, Spivak, McClelland, Maier & Neustadt, P.C.

[57] ABSTRACT

Turbine nozzles and turbine moving blades of an axial-flow turbine are provided which are capable of reducing a secondary flow loss with a simple structure. A nozzle blade passage formed by nozzle blades, an outer diaphragm ring and an inner diaphragm ring is structured in such a manner that the shapes of inner and outer walls of the nozzle blades are made to be irregular so that stepped portions (h1 at the root and h2 at the tip) each having curvature R are formed. The nozzle blades are formed in such a manner that ends (Zr, Zp and Zt) of a trailing edge of the nozzle blades are positioned at the most downstream position at the central portion of the nozzle blades. Moreover, relationships Zt<Zr<Zp are satisfied. Similarly to the nozzle blade passage, the moving blades are formed in such a manner that stepped portions h3 and h4 each having curvature R are formed in the moving blade passage. The central portion of the lengthwise direction of the moving blades is made to be lower than a straight line connecting a trailing edge of the root and a trailing edge of the tip to each other. Thus a moving blade passage is formed in which the distance from the line connecting the trailing edge and the outer surface of the trailing edge is a maximum length.

3 Claims, 15 Drawing Sheets

LOSS WITH NOZZLE

LOSS WITH
MOUVING BLADES

TURBINE NOZZLE AND MOVING BLADE OF AXIAL-FLOW TURBINE

BACKGROUND OF THE INVENTION

Field of the Invention

The present invention relates to an axial-flow turbine, and more particularly to a turbine nozzle and a moving blade forming a fluid passage of the axial-flow turbine.

A variety of techniques relating to the axial-flow turbine have been employed to improve an internal efficiency of the turbine so as to improve the performance of the same. Since a secondary flow loss among internal losses experienced with the axial-flow turbine is a loss of a type common to all stages of the turbine, a contrivance that is capable of preventing the above-mentioned loss has been required.

FIG. 19 shows cross sections of turbine stages of a usual axial-flow turbine including nozzle blades and moving blades. Referring to FIG. 19, a plurality of nozzle blades 4 are radially secured between an outer diaphragm ring 2 and an inner diaphragm ring 3 which are fit to a turbine casing 1 so that a nozzle blade passage is formed. A plurality of moving blades 6 is disposed at a downstream side of the nozzle blade passage. Each of moving blades 6 is sequentially implanted in the outer surface of the rotor wheel 5 at predetermined intervals in the circumferential direction of the rotor wheel 5. The tip of the moving blades 6 are attached to a cover 7 so that leakage of working fluid is prevented. Both the nozzle blades 4 and the moving blades 6 form a working fluid passage of this stage of the turbine.

A next (second) stage of the turbine, which is located at a downstream side of the above (first) stage, has a rapidly enlarged passage for the working fluid. This passage is composed of a nozzle blade passage and a moving blade passage as well as the above working fluid passage. The nozzle blade passage is formed by an outer diaphragm ring 8, an inner diaphragm ring 9 and nozzle blades 10. The moving blade passage is formed by both moving blades 12 implanted in a rotor wheel 11 and a cover 13 attached to the tip of the moving blades 12.

In the second stage, the working fluid expands from a high-pressure condition to a low-pressure condition through the passage, so the specific capacity (volume) of the fluid enlarges. To correspond to such enlargement of specific capacity, the inner wall of the passage is inclined in such a manner that the area of the passage is enlarged in the downstream direction.

Through the above-mentioned passage of the two stages, the working fluid generates a secondary flow at the nozzle blades 4 and 10. This mechanism of generating the secondary flow will now be described with reference to FIG. 20.

When the working fluid, which is high-pressure steam or the like, flows in the nozzle blade passage between the nozzle blades, the working fluid is curved into a circular arc form in the nozzle blade passage as indicated with a two-dot chain line shown in FIG. 20. At this time, centrifugal components are generated in a direction from an extrados E of the nozzle blade 4 to an intrados F of an adjacent nozzle blade 4. Since the centrifugal components and the pressure in the nozzle blade passage are in equilibrium, the static pressure at the intrados F of the nozzle blade 4 is raised.

On the other hand, the pressure at the extrados E of the nozzle blade 4 is lowered because the flow velocity of the working fluid is high along the extrados E. As a result, a pressure gradient is generated in a region of the nozzle blade passage from the intrados F of the nozzle blade 4 to the extrados E of an adjacent nozzle blade 4. As shown in FIG. 20, also a pressure gradient of the foregoing type is generated between the inner wall of the root of the nozzle blades and a layer adjacent to the outer surface of the tip of the nozzle blades in which the flow velocity is low, that is, in the boundary layer. In the portions adjacent to the boundary layer, the flow velocity is low and the acting centrifugal component is weak. Therefore, the flow of the working fluid cannot withstand the pressure gradient generated in a direction from the intrados F of the nozzle blade 4 to the extrados E of an adjacent blade. As a result, the flows are generated in a direction from the intrados F of the nozzle blade 4 to the extrados E of an adjacent nozzle blade, as indicated with symbols f1 and f2 shown in FIG. 20. The flows f1 and f2 collide with the extrados E of the nozzle blade 4 and curl up. As a result, secondary flow eddies 14*a* and 14*b* are generated adjacent to the inner wall of the root of the nozzle blades 4 and the outer wall of the tip of the same.

FIG. 21 is a diagram showing a mechanism of the moving blades 6 disposed downstream from the nozzle blades 4 to generate a secondary flow. Since the mechanism of the secondary flow the moving blades 6 is substantially the same as the mechanism of the nozzle blades 4 to generate eddies in the secondary flow. Features that are similar to those shown in FIG. 20 are given the same reference numerals and symbols. As can be understood from FIGS. 22 and 23 showing losses of the nozzle blades 4 and the moving blades 6, eddy losses are caused from the secondary flow eddies. Thus, excessive losses are produced in the portions adjacent to the inner and outer walls of the turbine blades.

If secondary flow eddies 14*a* and 14*b* are generated, a portion of energy of the working fluid is dispersed. Moreover, non-uniform flows of the working fluid are formed, thus causing a problem to arise in that losses of the nozzle blades and the moving blades are enlarged and the performance of the stages deteriorate excessively.

To prevent the secondary flow loss caused by the secondary flow eddies 14*a* and 14*b* generated in the abovementioned passage (stages), a variety of techniques have been researched and developed. For example, a nozzle blade having a reduced outer surface has been employed. This reduced outer surface has irregularities formed in the tip of the nozzle blade to reduce the height of the flow passage in the downstream direction. FIG. 24 is a cross sectional view showing a turbine nozzle having the nozzle blade 15 having a reduced outer surface. The nozzle blade 15 having the reduced outer surface causes flows along the outer surface of the nozzle blade 15. Thus, the flow line is shifted toward the inside portion (toward the central portion) of the nozzle blade passage as indicated with an arrow ft. This configuration further provides that the flow lines in the central portion and the root (inside) portion are shifted inwards (toward the central portion), as indicated by arrows fp and fr, in a manner similar to those along the outer surface. As a result, the flow lines push the flows to the inner wall of the nozzle blade 15 in portions adjacent to the root of the nozzle blade 15. Thus, enlargement of the boundary along the inner wall can be prevented so that enlargement of the loss caused by the secondary flow eddies is prevented.

FIG. 25 shows a distribution of reduced losses attributable to the effect of the conventional nozzle blade 15 having the reduced outer surface to prevent enlargement of losses caused by eddies in the secondary flow. As can be understood from FIG. 25, losses can be significantly reduced in the portions adjacent to the root of the nozzle blade. Improvement in the performance has been confirmed also in overall efficiency experiments of the turbine stages.

The fact that the nozzle blade 15 having the reduced outer surface is able to improve the performance has been confirmed in the above-mentioned stage efficiency experiments. However, local separation of the flow at the tip of the nozzle blade takes place that is attributable to a rapid shift of the flow line, as shown in the distribution of losses in the trailing edge of the nozzle blade. Therefore, the secondary flow cannot satisfactorily be improved.

Moreover, a large portion of the working fluid flows adjacent to the root of the nozzle blade. Therefore, considerable change in the flow rate occurs in the direction of the height of the nozzle blade.

Therefore, the stage performance realized by the nozzle blade 15 having the reduced outer surface can be further improved. That is, a nozzle blade passage is required which is capable of preventing separation of flows of the working fluid and improving the flow rate characteristic at the tip of the nozzle blade.

SUMMARY OF THE INVENTION

In view of the foregoing an object of the present invention is to provide a turbine nozzle and a turbine moving blade of an axial-flow turbine capable of reducing a loss in the secondary flow with a simple structure.

This object can be achieved according to the present invention by providing an axial-flow turbine comprising: an outer diaphragm ring and an inner diaphragm ring forming together an annular fluid passage; and a plurality of nozzle blades disposed in the annular passage, each of the nozzle blades being formed into a warped shape such that a central portion in a lengthwise direction of the nozzle blade maximally projects in a downstream direction.

In preferred embodiments, the annular fluid passage has a stepped portion at an inner surface of the outer diaphragm ring and an outer surface of the inner diaphragm ring, the stepped portion having a curvature surface so that the height of the fluid passage is reduced in a downstream direction thereof.

The stepped portion has a height in a radial direction of the fluid passage, the height being described by the relationships:

$$0 \leqq h1/L1 < 0.05$$

$$0.1 < h2/L1 < 0.2$$

where L1 is the height of a leading edge of the nozzle blades, h1 is the height of the stepped portion provided for the inner diaphragm ring and h2 is the height of the stepped portion provided for the outer diaphragm ring.

Each of said turbine blades has an axial distance from the leading edge of the diaphragm to the trailing edge of the nozzle blades, the distance being described by the relationships:

$$Zt < Zr < Zp$$

where Zt is the distance at the outermost end of the nozzle blades, Zr is the distance at the innermost end of the same and Zp is the distance at the central portion of the same.

The height L2 of the nozzle blades at a trailing edge is made to be smaller than the height L1 of the nozzle blades at a leading edge (that is, L1>L2).

The fluid passage is structured such that the inner surface of the outer diaphragm ring and the outer surface of the inner diaphragm ring are inclined outwards in the downstream direction.

An angle of inclination of said fluid passage is described by the relationships:

$$0° \leqq \theta1 < \theta3 < \theta2$$

where θ1 is an angle of inclination of the outer surface of the inner diaphragm ring, θ2 is an angle of inclination of the inner surface of the outer diaphragm ring in the leading edge of the nozzle blades and θ3 is an angle of inclination of a portion of the inner surface of the outer diaphragm ring following the trailing edge of the nozzle blades.

The height L2 of the nozzle blades at a trailing edge is made to be larger than the height L1 of the nozzle blades at a leading edge (that is, L1≦L2).

The fluid passage is structured such that the inner surface of the outer diaphragm ring is inclined outwards in the downstream direction and the outer surface of the inner diaphragm ring is inclined inwards in the downstream direction.

An angle of inclination of said fluid passage is descried by the relationships:

$$\theta1 < 0° < \theta3 < \theta2$$

where θ1 is an angle of inclination of the outer surface of the inner diaphragm ring, θ2 is an angle of inclination of the inner surface of the outer diaphragm ring in the leading edge of the nozzle blades and θ3 is an angle of inclination of a portion of the inner surface of the outer diaphragm ring following the trailing edge of the nozzle blades.

The fluid passage is structured such that the cross sections of the nozzle blades at the tip and the root of the nozzle blades are shifted in the circumferential direction of the annular fluid passage.

A throat width between adjacent two nozzle blades is determined by the relationships:

$$Sp \leqq Sr < St$$

where Sp is the throat width at the central portion in the lengthwise direction of the nozzle blades, Sr is that at the root and St is that at the tip.

A further embodiment of the present invention includes an axial-flow turbine comprising: an outer diaphragm ring and an inner diaphragm ring forming together an annular fluid passage; and a plurality of nozzle blades disposed in the annular passage, wherein said annular fluid passage has a stepped portion at an inner surface of the outer diaphragm ring and an outer surface of the inner diaphragm ring, the stepped portion having a curvature surface so that the height of the fluid passage is reduced in a downstream direction thereof.

In preferred embodiments, the fluid passage is structured such that the cross sections of the nozzle blades at the tip and the root of the nozzle blades are shifted in the circumferential direction of the annular fluid passage.

A throat width between adjacent two nozzle blades is determined by the relationships:

$$Sp \leqq Sr < St$$

where Sp is the throat width at the central portion in the lengthwise direction of the nozzle blades, Sr is that at the root and St is that at the tip.

A further embodiment of the present invention includes an axial-flow turbine comprising: an outer diaphragm ring and an inner diaphragm ring forming together an annular fluid passage; and a plurality of nozzle blades disposed in the annular passage, wherein the height of the nozzle blades at a trailing edge is made to be larger than the height of the nozzle blades at a leading edge, the annular fluid passage having a stepped portion at an inner surface of the outer diaphragm ring, the stepped portion having a curvature surface so that the height of the fluid passage is reduced in a downstream direction thereof, the height of the fluid passage being enlarged at a position adjacent to the trailing edge of the nozzle blades, the inner trailing edge of the nozzle blades being positioned in the most downstream position and the outer trailing edge being positioned in the most upstream position.

In preferred embodiments, the stepped portion has a height in a radial direction of the fluid passage, the height being described by the relationships:

$$0.1<h2/L1<0.2$$

where L1 is the height of a leading edge of the nozzle blades and h2 is the height of the stepped portion provided for the outer diaphragm ring.

The above object can be achieved according to the present invention by providing an axial-flow turbine comprising: a rotor wheel; a plurality of moving blades disposed on an outer surface of the rotor wheel; and an annular cover attached to a tip of each of the moving blades, the annular cover and the rotor wheel forming a annular fluid passage, wherein the moving blades are formed into a warped shape in such a manner that the lengthwise directional central portion of the moving blades at the trailing edge of the moving blades is lower than a straight line connecting a trailing edge at the root to a trailing edge at the tip.

In preferred embodiments, the annular fluid passage has a stepped portion at an outer surface of the rotor wheel and an inner surface of the cover, the stepped portion having a curvature surface so that the height of the fluid passage is reduced in a downstream direction thereof.

The stepped portion has a height in a radial direction of the fluid passage, the height being described by the relationships:

$$0\leqq h3/L3<0.05$$

$$0.1<h4/L3<0.2$$

where L3 is the height of the leading edge of the moving blades, L4 is the height of the trailing edge of the moving blades, h3 is the height of the stepped portion provided for the rotor wheel and h4 is the height of the stepped portion provided for the cover.

Each of said moving blades is structured such that an axial distance from points on a line connecting a trailing edge of a root of the moving blades to a trailing edge at the tip to points on a curved line forming a trailing edge of the moving blades are longest in the central portion of the lengthwise direction of the moving blades at the trailing edge of the moving blades.

The fluid passage is structured such that the inner surface of the cover and the outer surface of the rotor wheel are inclined outwards in the downstream direction.

An angle of inclination of said fluid passage is described by the relationships:

$$0^\circ\leqq\theta1<\theta3<\theta2$$

where θ1 is an angle of inclination of the outer surface of the rotor wheel, θ2 is an angle of inclination of the inner surface of the cover at the leading edge of the moving blades and θ3 is an angle of inclination of a portion of the inner surface of the cover following the trailing edge of the moving blades.

The height L4 of the moving blades at the trailing edge is made to be larger than the height L3 of the moving blades at the leading edge (L3≦14).

The fluid passage is structured such that the inner surface of the cover is inclined outwards in the downstream direction and the outer surface of the rotor wheel is inclined inwards in the downstream direction.

An angle of inclination of said fluid passage is described by the relationships:

$$\theta1<0^\circ<\theta3<\theta2$$

where θ1 is an angle of inclination of the outer surface of the rotor wheel is, θ2 is an angle of inclination of the inner surface of the cover at the leading edge of the moving blades and θ3 is an angle of inclination of a portion of the inner surface of the cover following the trailing edge of the moving blades.

The fluid passage is structured such that the cross sections of the outer and inner portions of the moving blades are shifted in the circumferential direction of the rotor wheel.

A throat width between adjacent two moving blades is determined by the relationships:

$$Sr>Sp<St$$

where Sp is the width of the central portion in the lengthwise direction of the moving blades, Sr is that at the root and St is that at the tip.

A further embodiment of the present invention includes an axial-flow turbine comprising: a rotor wheel; a plurality of moving blades disposed on an outer surface of the rotor wheel; and an annular cover attached to an outer end each of the moving blades, the annular cover and the rotor wheel forming an annular fluid passage, wherein said annular fluid passage has a stepped portion at an outer surface of the rotor wheel and an inner surface of the cover, the stepped portion having a curvature surface so that the height of the fluid passage is reduced in a downstream direction thereof.

In preferred embodiments, the fluid passage is structured such that the cross sections of the outer and inner portions of the moving blades are shifted in the circumferential direction of the rotor wheel.

A throat width between adjacent two moving blades is determined by the relationships:

$$Sr>Sp<St$$

where Sp is the width of the central portion in the lengthwise direction of the moving blades, Sr is that at the root and St is that at the tip.

The turbine nozzle or the turbine moving blades having the above-mentioned structure of the present invention causes the working fluid introduced to the portions adjacent to the tip and root portions of the fluid passage by the nozzle blade or the moving blade to be narrowed by the stage of the wall of the fluid passage. Thus, eddies in the secondary flow between blades can be prevented and the secondary loss can be reduced.

Since the trailing edge of the nozzle blade and that of the moving blade are disposed downstream in the central portion of the blade, the flow lines of the portions of the working fluid in each of the nozzle blade and the moving blade are shifted to the tip and root portions. As a result, the distribution of the flows in the lengthwise direction of the blade can be uniformed. Thus, energy can effectively be converted by the moving blades. Therefore, the abovementioned functions improve the performance of the turbine stages.

BRIEF DESCRIPTION OF THE DRAWINGS

The accompanying drawings which are incorporated in and constitute a part of this specification, illustrate embodiments of the present invention and, together with the description, serve to explain the principles of the present invention; in which.

DETAILED DESCRIPTION OF PREFERRED EMBODIMENTS

Referring to FIGS. 1 to 18, embodiments of the present invention will now be described.

First Embodiment

Figure 1:
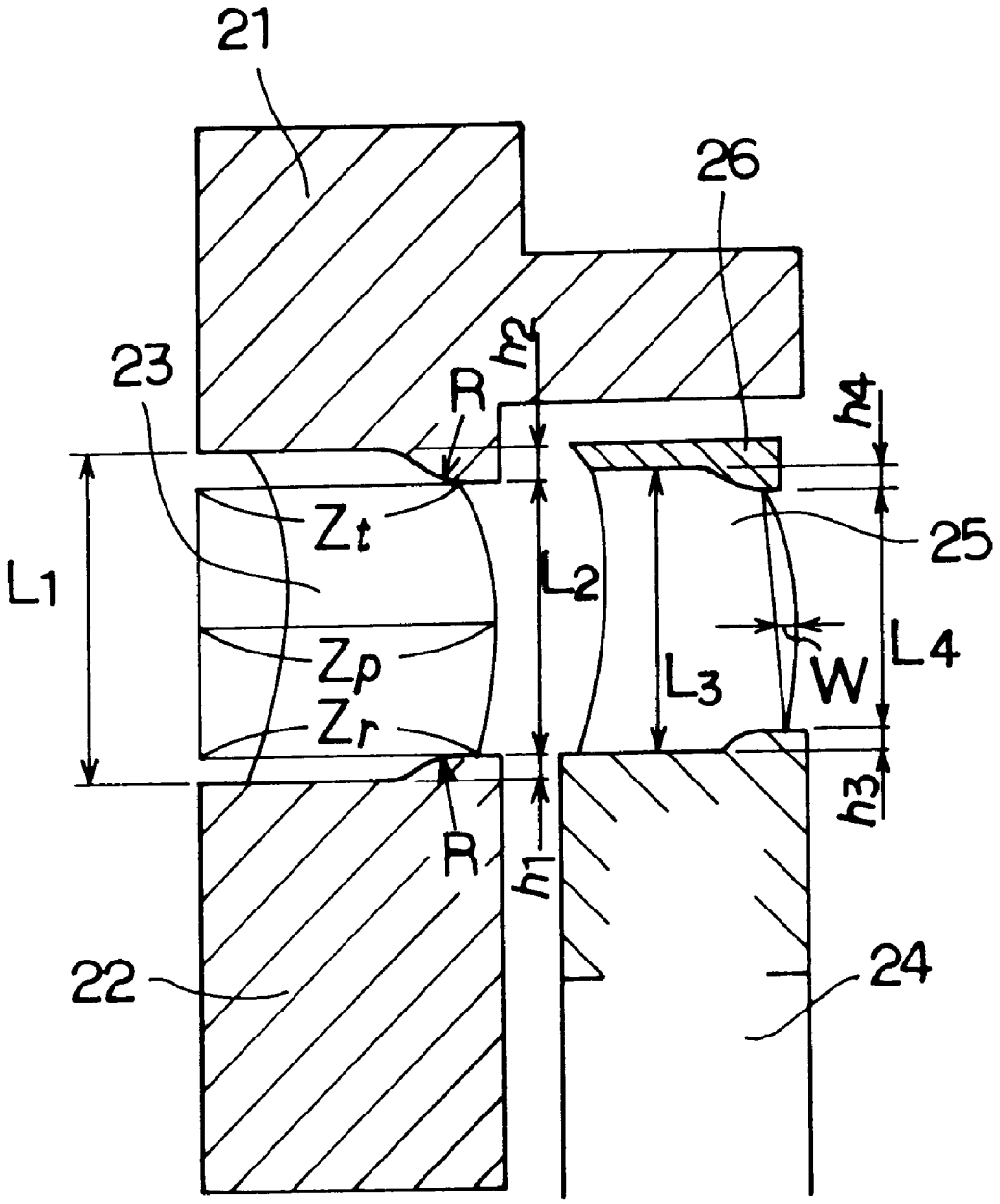
FIG. 1 is a cross sectional view showing a first embodiment of a turbine boundary layer of an axial-flow turbine according to the present invention.

A first embodiment of the present invention will now be described with reference to FIGS. 1 to 3. Referring to FIG. 1, a plurality of nozzle blades 23 are sequentially disposed at predetermined intervals in a circumferential direction of an annular fluid passage formed by an outer diaphragm ring 21 and an inner diaphragm ring 22. The tip and the root of each of the nozzle blades 23 are joined to the outer diaphragm ring 21 and the inner diaphragm ring 22 so that a turbine nozzle is formed.

A plurality of moving blades 25 are sequentially implanted on the outer surface of a rotor wheel 24 at predetermined intervals in the circumferential direction of the rotor wheel 24. Moreover, a cover 26 is attached to be in contact with the tip of the moving blades 25. Thus, turbine moving blades are formed.

Note that description will hereinafter be made in such a manner that the inner surface of the outer diaphragm ring 21 is called a "an outer wall of a nozzle blade", the outer surface of the inner diaphragm ring 22 is called an "inner wall of the nozzle blade", the outer surface of the rotor wheel 24 is called an "inner wall of the moving blade" and the inner surface of the cover 26 is called an "outer wall of the moving blade".

A nozzle blade passage is formed by the nozzle blades 23, the outer diaphragm ring 21 and the inner diaphragm ring 22. The nozzle blade passage is formed in such a manner that the outer and inner walls are formed into irregular shape so that stepped portions (a stepped portion h1 at the root and a stepped portion h2 at the tip) each having a curvature R are formed.

Figure 2:
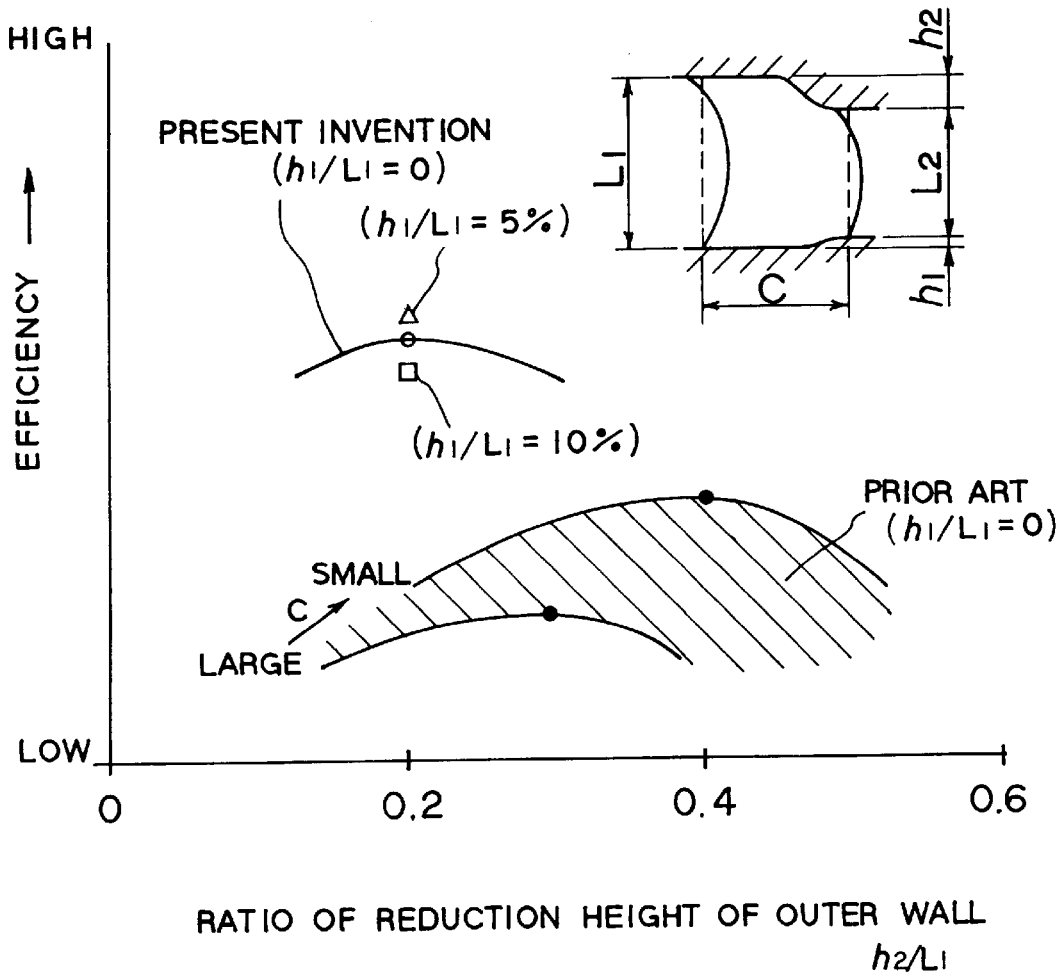
FIG. 2 is a graph showing flow efficiency relationship for a ratio of reduction height of the outer wall (h1/L1)

FIG. 2 shows an example of dimensions determining an inner wall state of the nozzle blade passage in this embodiment. As shown in FIG. 2, the above-mentioned conventional nozzle, i.e. non-curved type has a maximum level of flow efficiency when the ratio of reducing the height of the outer wall defined as h1/L1 is 0.3 to 0.4, where h1 is a height of the stepped portion and L1 is a height of the leading edge of the nozzle blade. On the other side, the nozzle in this embodiment has a maximum level of flow efficiency when the ratio is approximately 0.2, and this level is higher than the maximum level of the conventional nozzle. The effective ratio (h1/L1) of the embodiment type is lower than the one of the conventional type, because the embodiment type improves a fluid flow of the passage by curving the blade to the downstream side in the axial direction.

Also, it is preferable that the stepped portion h1 at the tip has a height that is about 20% of the height L1 of the leading edge of the nozzle blades. If the height is larger than about 20%, the above-mentioned flow efficiency substantially reduces. Therefore, the effective height of the stepped portion h2 at the tip is 0.1 to 0.2 percent of the height L1 of the leading edge of the nozzle blade.

The height of the stepped portion h1 at the root has a component in the outside direction of a discharge velocity vector from the nozzle blades. If the height of the stepped portion h1 at the root is enlarged, separation easily takes place because of the curvature of the inner wall. As shown in FIG. 2, if the ratio (h1/L1) exceeds the effective level, the efficiency substantially reduces. This ratio shows an effect of reducing the height at the root portion. Therefore, an allowable height of the stepped portion at the root is about 5% of the height of the leading edge of the nozzle blades. The most effective height h1 of the stepped portion at the root is less than or equal to 0.05 percent of the height L1 of the inlet portion of the nozzle blades.

This embodiment is arranged to moderate rapid shift of the flow line along the curved portion formed in the trailing edge between the inner and outer walls of the nozzle blades 23 and having the curvature R. The moderation is performed by forming the nozzle blades 23 in such a manner that the positions (positions Zr, Zp and Zt) of the trailing edge of the nozzle blades are positioned at the most downstream position and relationships Zt<Zr<Zp are satisfied. Since the trailing edge of the nozzle is formed as described above, flows along the outer surfaces of the nozzle blades are deflected toward the outer surfaces of the nozzle blades and the flows along the inner surfaces of the nozzle blades are deflected toward the inside portion of the nozzle blades. Thus, an effect can be obtained in that separation of flows at the stepped portion having the curvature R can be prevented.

Also the moving blades 25 disposed downstream from the nozzle blades 23 are provided with stepped portions h3 and h4 formed in the passage in the moving blades and each having a curvature R. Also in this case, the same effect as that obtainable from the above-mentioned stepped portion can be obtained. An effective height of the stepped portion h4 at the tip of the moving blades 25 is 0.1 time to 0.2 time of height L3 of an leading edge of the moving blades 25. On the other hand, an effective height of the stepped portion h3 at the root of the moving blades 25 is 0.05 time or smaller the height L3 of an leading edge of the moving blades 25.

The central portion of the lengthwise direction of the moving blades 25 is made to be lower than an trailing edge line which connects the trailing edge of the root and the tip. Moreover, the moving blade passage is formed in such a manner that axial distance W between the outlet line and the outer surface of the outlet portion is made to be a maximum distance. In other words, each of said moving blades 25 is structured such that the axial distance W from points on a line connecting between the root and tip of the trailing edge thereof to points on a curved line forming the trailing edge are longest in the central portion of the lengthwise direction at the trailing edge thereof. Thus, rapid shift of the flow line at the stepped portion having the curvature R is moderated.

Figure 3A:
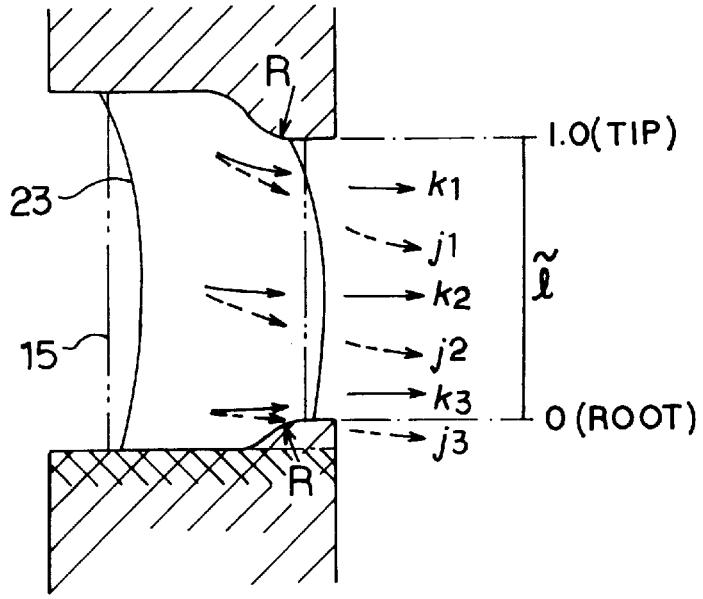
FIG. 3A is a diagram showing flows of working fluid in a nozzle blade passage in the stage structure shown in FIG. 1.
Figure 3B:
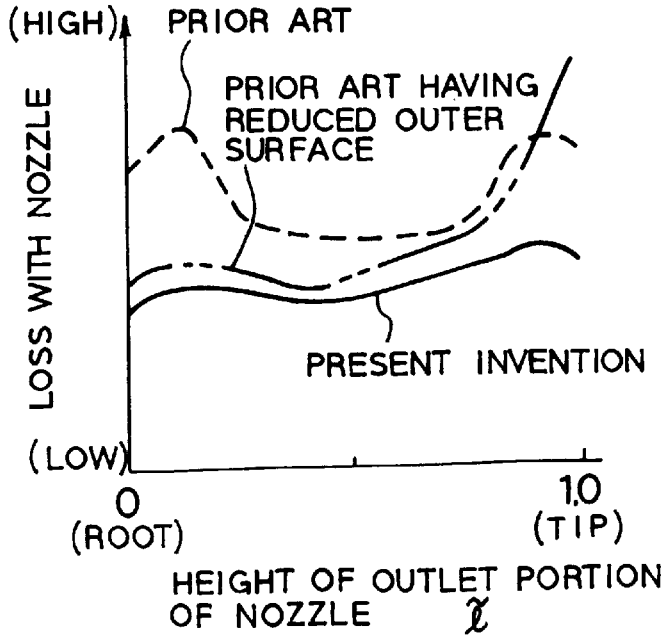
FIG. 3B is a graph showing distribution of losses in the nozzle blade passage in the stage structure shown in FIG. 1.

FIGS. 3A and 3B show flows in the nozzle blade passage and distribution of losses occurring in the same. A result of a comparison of flows of the working fluid between the conventional nozzle blade 15 having the reduced outer surface and the nozzle blades 23 according to this embodiment will now be described with reference to FIG. 3A. Referring to FIG. 3A, the conventional nozzle blade 15 having the reduced outer surface results in a flow j1 along the outer surface being considerably deflected toward the root because of the curvature R of the outer wall. Also flows j2 and j3 are considerably deflected to the root. Although the foregoing shifts of the flow lines reduce eddies in the secondary flow adjacent to the root, the flow lines are shifted excessively in the portions adjacent to the tip. As a result, distribution of the flow rate in the lengthwise direction of the blade is made to be nonuniform.

On the other hand, the nozzle blades 23 according to this embodiment have a stepped portion having a curvature R on the inner wall in addition to the conventional nozzle blade 15 having the reduced outer surface. Since the trailing edge of the nozzle blades is formed at the most downstream portion in the central portion of the lengthwise direction of the nozzle blade, a flow K1 along the outer surface discharged from the trailing edge of the nozzle blades is returned to the outer surface. A flow K2 in the central portion of the lengthwise direction of the blade flows in substantially the central portion. A flow K3 along the inside portion moderates rapid shift of the flow line occurring attributable to the curvature R of the surface of the wall.

As a result, eddies of the secondary flow along the outer and inner walls of the nozzle blades can be reduced. Moreover, separation of the flows at the stepped portion having the curvature R can be prevented. FIG. 3B shows a result of a comparison between the conventional nozzle blades and the nozzle blades according to this embodiment. As can be understood from FIG. 3B, the nozzle blades 23 according to this embodiment reduce losses at the tip thereof.

Also the moving blades 25 shown in FIG. 1 have the same function as that of the nozzle blades 23. As described above, both of the nozzle blades and the moving blades have the stepped portions each having the curvature R on the inner and outer walls. Moreover, the lengthwise directional central portions of the nozzle blades and the moving blades are formed in the downstream positions. Thus, an effect of reducing losses in the secondary flow along the outer wall and the inner wall can be obtained. As a result, the efficiency of the turbine stage can be improved.

Second Embodiment

Figure 4:
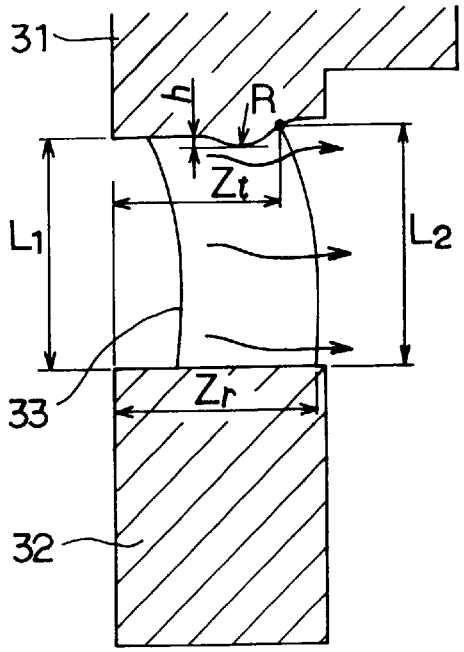
FIG. 4 is a cross sectional view showing a nozzle blade passage according to a second embodiment of a turbine blade of the axial-flow turbine according to the present invention.

FIG. 4 is a cross sectional view showing a nozzle blade passage according to a second embodiment of the present invention.

As shown in FIG. 4, a nozzle blade passage of the second embodiment is structured in such a manner that height L2 of the trailing edge of the nozzle blades 33 disposed in an annular passage formed by an outer diaphragm 31 and an inner diaphragm 32 is made to be larger than the height L1 of the leading edge of the nozzle blades 33 (LI≦L2). The nozzle blade passage according to this embodiment is formed in such a manner that the outer wall of the nozzle blades is first made to be irregular in the nozzle blade passage to reduce the height of the passage. Moreover, the height of the passage is enlarged in a portion adjacent to the trailing edge of the nozzle. The trailing edge of nozzle blades 33 is arranged to be positioned in the most downstream portion at the root and in the most upstream portion at the tip.

This embodiment has a structure that the stepped portion of the outer wall of the nozzle blades 33 is formed to satisfy the same range provided for the nozzle blades 23. Thus, the same effect as that of the first embodiment can be obtained.

Third Embodiment

Figure 5:
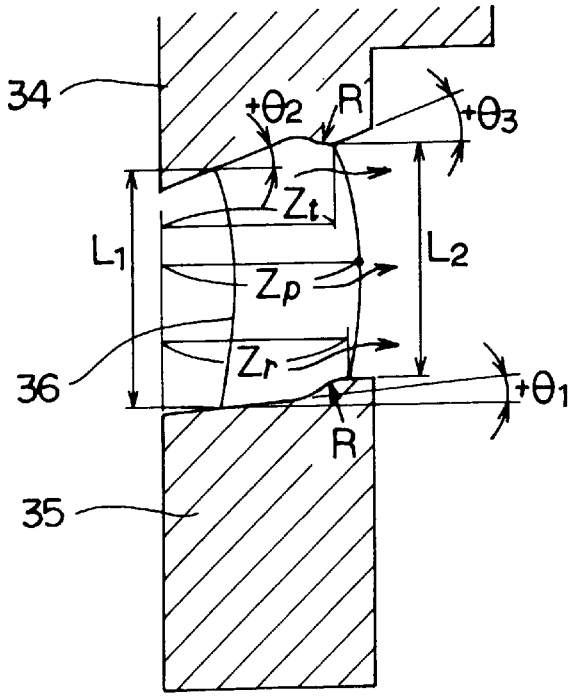
FIG. 5 is a cross sectional view showing a nozzle blade passage according to a third embodiment of a turbine blade of the axial-flow turbine according to the present invention.

FIG. 5 is a cross sectional view showing a nozzle blade passage according to a third embodiment of the present invention.

As shown in FIG. 5, a nozzle blade passage of the third embodiment is formed in such a manner that the outer and inner walls of the nozzle blades 36 disposed in an annular passage formed by an outer diaphragm 34 and an inner diaphragm 35 are inclined outwards in the downstream direction. The angle of inclination of each wall is determined as follows:

$0° \leqq$(inclination angle θ1 of inner wall)<(inclination angle θ3 of outer wall following trailing edge of nozzle blades)<(inclination angle θ2 of outer wall of leading edge of nozzle blades), wherein each of inclination angles θ1, θ2, and θ3 is defined by an angle between the surface of the corresponding wall and the axial direction of the passage.

Moreover, the trailing edge of the nozzle blades 36 is formed to satisfy the same range provided for the nozzle blades 23 so that a similar effect to that obtainable from the first embodiment is obtained.

Fourth Embodiment

Figure 6:
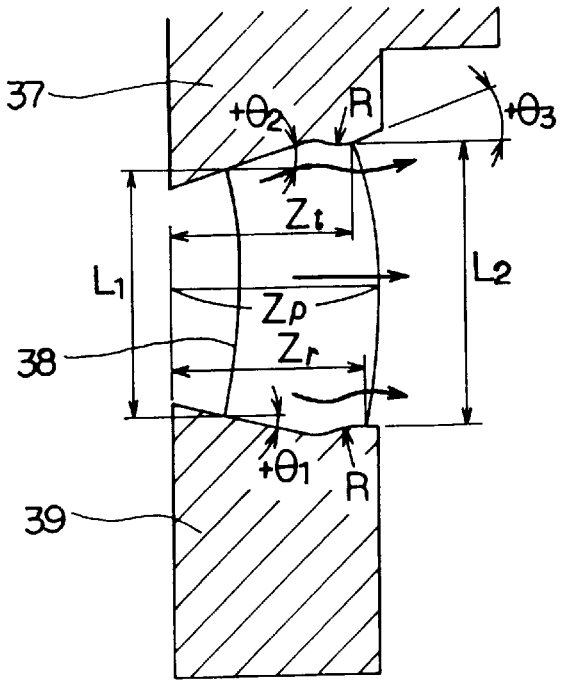
FIG. 6 is a cross sectional view showing a nozzle blade passage according to a fourth embodiment of a turbine blade of the axial-flow turbine according to the present invention.

FIG. 6 is a cross sectional view showing a nozzle blade passage according to a fourth embodiment of the present invention.

The fourth embodiment is arranged in such a manner that the height L2 of the trailing edge of nozzle blades 38 disposed in an annular passage formed by an outer diaphragm 37 and an inner diaphragm 39 is made to be larger than the height L1 of the leading edge of the nozzle blades (L1≦L2). Moreover, the outer wall of the nozzle blades is inclined toward the outside portion in the downstream direction and the inner wall of the nozzle blades 38 is inclined toward the inside portion in the downstream direction. The angles of inclination are determined as follows:

(inclination angle θ1 of inner wall of nozzle blades)<0°<(inclination angle θ3 of outer diaphragm ring 37 following trailing edge of nozzle blades)<(inclination angle θ2 of outer wall of leading edge of nozzle blades), wherein each of inclination angles θ1, θ2, and θ3 is defined by an angle between the surface of the corresponding wall and the axial direction of the passage.

The trailing edge of the nozzle blades 38 is formed to satisfy the same range provided for the nozzle blades 23 so that a similar effect to that obtainable from the first embodiment is obtained.

Fifth Embodiment

Figure 7:
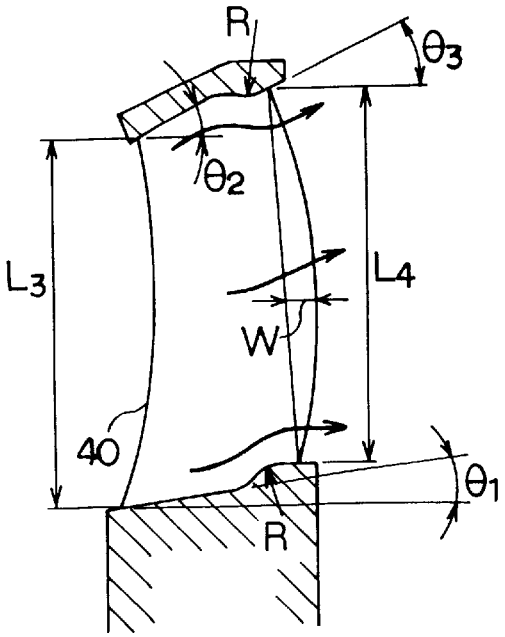
FIG. 7 is a cross sectional view showing a moving blade passage according to a fifth embodiment of a turbine blade of the axial-flow turbine according to the present invention.

FIG. 7 is a cross sectional view showing a moving blade passage according to a fifth embodiment of the present invention. As shown in FIG. 7, the moving blade passage according to the fifth embodiment is formed in such a manner that the outer and inner walls of the moving blades 40 are inclined toward the outside in the downstream direction. The angles of inclination are determined as follows:

$0° \leqq$(inclination angle θ1 of inner wall)<(inclination angle θ3 of cover following trailing edge of moving blades)<(inclination angle θ2 of outer wall of leading edge of moving blades), wherein each of inclination angles θ1, θ2, and θ3 is defined by an angle between the surface of the corresponding wall and the axial direction of the passage.

The trailing edge of the moving blades 40 is formed to satisfy the same range provided for the moving blades 25, for example, in FIG. 7, the axial direction W from points on a line connecting between the root and tip of the trailing edge of the moving blades 40 to points on a curved line forming the trailing edge thereof are longest in the central portion of the lengthwise direction at the trailing edge thereof, so that a similar effect to that obtainable from the second embodiment is obtained.

Sixth Embodiment

Figure 8:
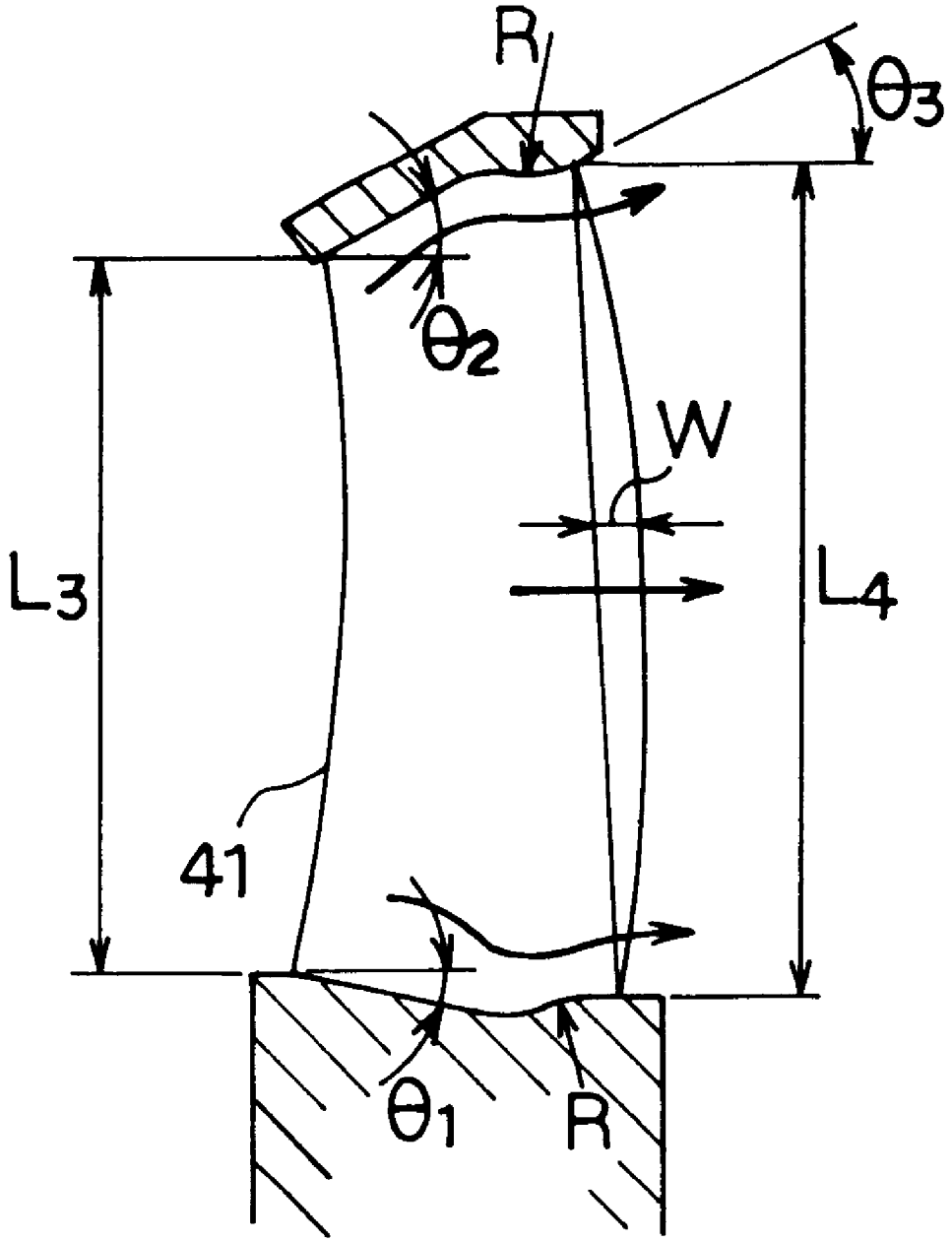
FIG. 8 is a cross sectional view showing a moving blade passage according to a sixth embodiment of a turbine blade of the axial-flow turbine according to the present invention.

FIG. 8 is a cross sectional view showing a sixth embodiment of the present invention.

As shown in FIG. 8, the sixth embodiment has a structure that the height L4 of the trailing edge of the moving blades 41 is made to be larger than the height L3 of a leading edge of the moving blades 41 (L3≦L4).

The moving blade passage is formed in such a manner that the moving blades 41 are inclined toward the outside portion in the downstream direction. Moreover, the inner wall of the moving blades 41 is inclined toward the inside portion in the downstream direction. The angles of inclination satisfy the following relationships:

(inclination angle θ1 of inner wall of moving blades 41)<0°<(inclination angle θ3 of outer wall following trailing edge of moving blades 41)<(inclination angle θ2 of outer wall of leading edge of moving blades 41), wherein each of inclination angles θ1, θ2, and θ3 is defined by an angle between the surface of the corresponding wall and the axial direction of the passage.

The trailing edge of the moving blades 41 is formed to satisfy the same range provided for the moving blades 25, for example, in FIG. 8, the axial direction W from points on a line connecting between the root and tip of the trailing edge of the moving blades 41 to points on a curved line forming the trailing edge thereof are longest in the central position of the lengthwise direction at the trailing edge thereof, so that a similar effect to that obtainable from the second embodiment is obtained.

Seventh Embodiment

Figure 9:
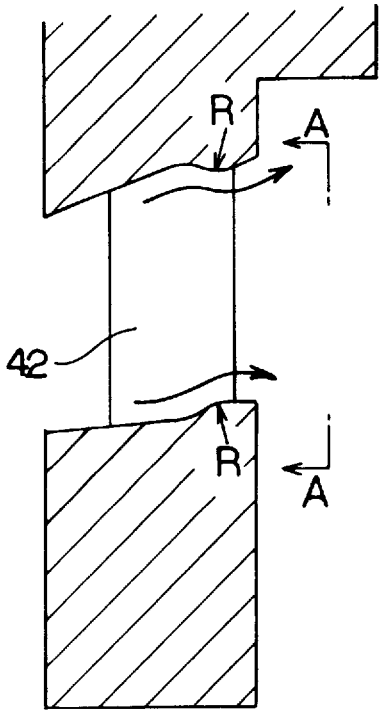
FIG. 9 is a cross sectional view showing a nozzle blade passage according to a seventh embodiment of a turbine blade of the axial-flow turbine according to the present invention.
Figure 10:
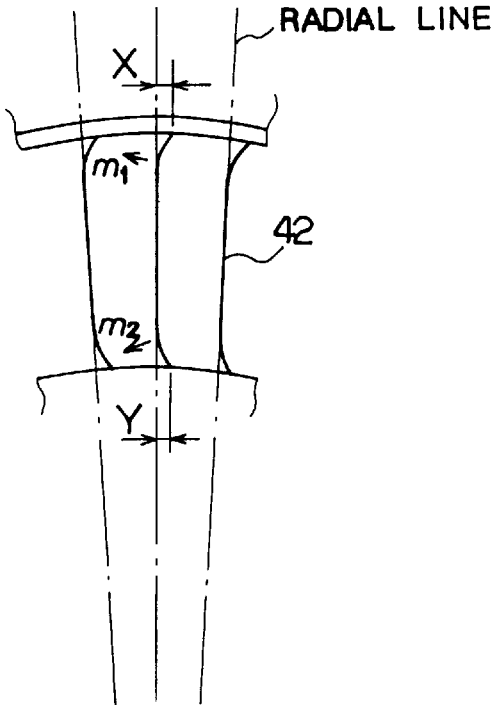
FIG. 10 is a cross sectional view taken along line AA shown in FIG. 9.

FIGS. 9 and 10 are cross sectional views showing a nozzle blade passage according to a seventh embodiment of the present invention.

As shown in FIG. 9, a nozzle blade passage according to the seventh embodiment is formed in such a manner that the outer and inner walls of the nozzle blades 42 adjacent to the trailing edge have stepped portions each having the curvature R. Thus, eddies in the secondary flow at the tip and the root of the nozzle blades 42 can be reduced.

In this embodiment, separation of flows along the outer and inner walls of the trailing edge of the nozzle blades is prevented which occurs due to rapid shift of the flow line caused from the stepped portion formed adjacent to the trailing edge of the nozzle blades and having the curvature R. To prevent the separation, the tips and the roots of the nozzle blades 42 are shifted in the circumferential direction (by X and Y) as shown in FIG. 10 to push the flow of the working fluid to the wall surface (flows m1 and m2). Thus, local separation is prevented.

As a result, a similar effect to that obtainable from the first embodiment can be obtained.

Eighth Embodiment

Figure 11:
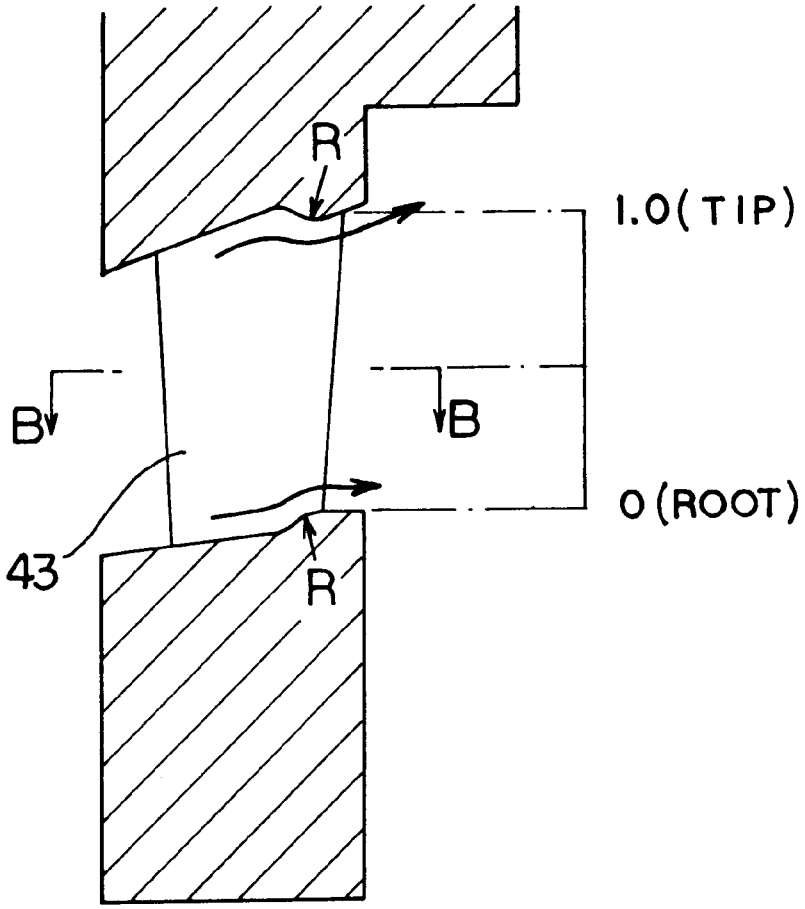
FIG. 11 is a cross sectional view showing a nozzle blade passage according to an eighth embodiment of a turbine blade of the axial-flow turbine according to the present invention.

FIG. 11 is a cross sectional view showing a nozzle blade passage according to an eighth embodiment of the present invention.

The nozzle blade passage according to this embodiment has stepped portions provided for the outer and inner walls of the nozzle blades 43 and each having a stepped portion having a curvature R. Thus, eddies in the secondary flow at the tip and the root of the nozzle blades 43 can be prevented.

Figure 12:
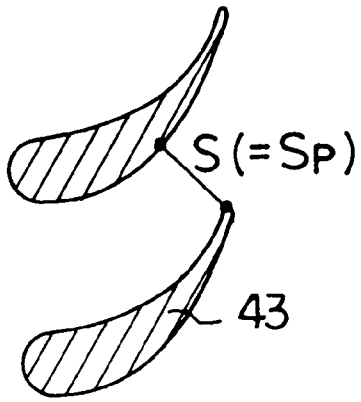
FIG. 12 is a cross sectional view taken along line BB shown in FIG. 11.

Separation of flows along the outer and inner walls at the trailing edge of the nozzle blades is prevented which occurs due to rapid shift of the flow line caused from the stepped portion having the curvature R. To prevent the separation, the dimensions of the throat (indicated with symbol S) between nozzle blades 43 shown in FIG. 12 are determined to satisfy the following relationships:

$$Sp \leqq Sr < St.$$

Figure 13:
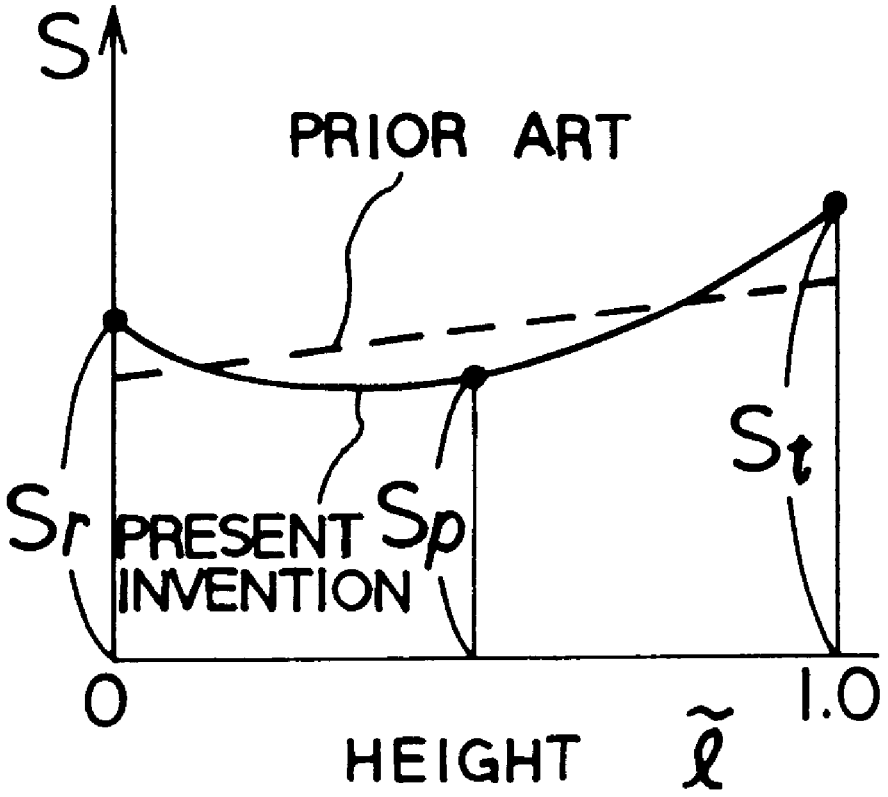
FIG. 13 is a graph showing dimensions of a throat between nozzle blades shown in FIG. 12.

The foregoing throat distribution enables the flow rate of the working fluid to be enlarged along the inner and outer walls of the nozzle blades as compared with the conventional structure, as shown in FIG. 13. Since the flow rate is controlled as described above, a similar effect obtainable from the first embodiment can be obtained.

Ninth Embodiment

Figure 14:
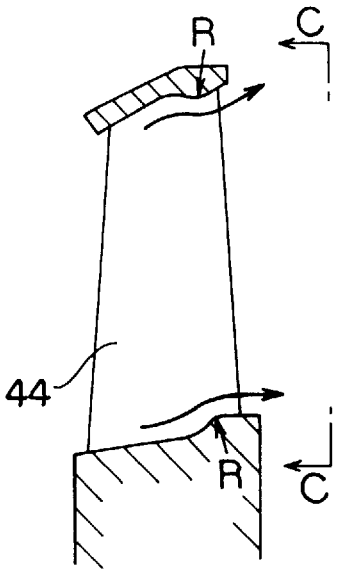
FIG. 14 is a cross sectional view showing a moving blade passage according to a ninth embodiment of a turbine blade of the axial-flow turbine according to the present invention.

FIG. 14 is a cross sectional view showing a moving blade passage according to a ninth embodiment of the present invention.

Figure 15:
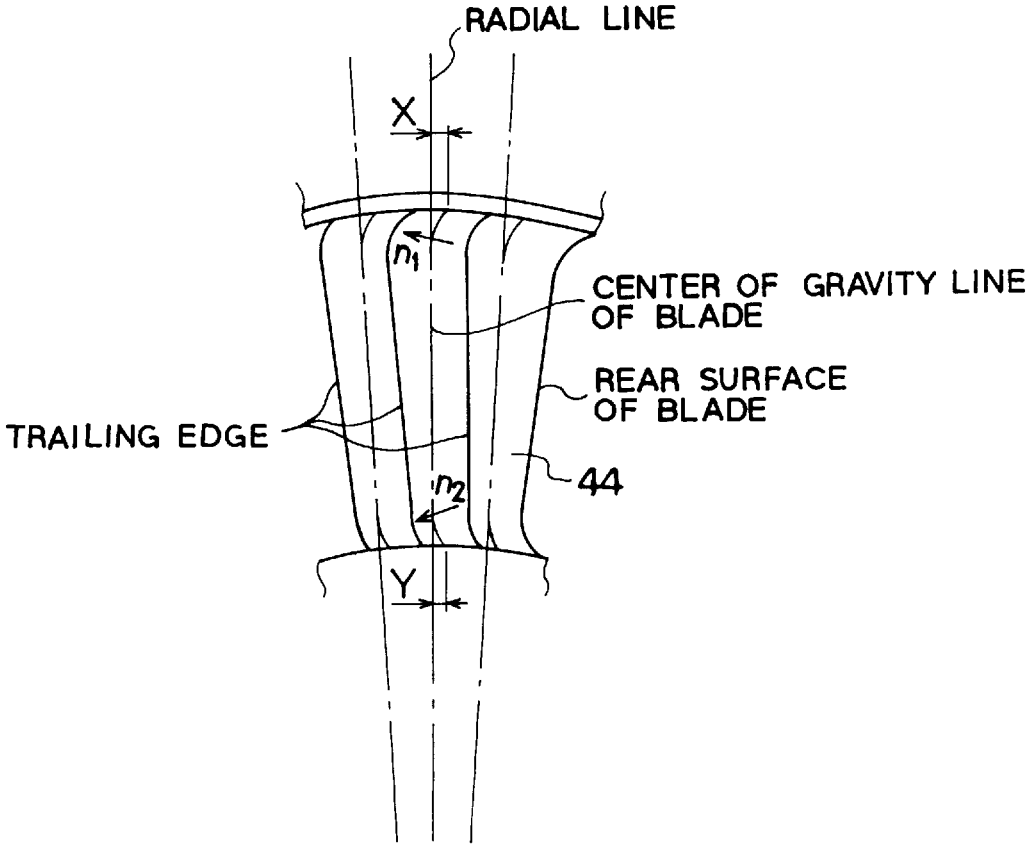
FIG. 15 is a cross sectional view taken along line C—C shown in FIG. 14.

The moving blade passage according to the ninth embodiment has a structure that stepped portions each having the curvature R are provided for the inner and outer walls of the moving blades. Thus, eddies in the secondary flow at the tip and the root of the moving blades 44 can be reduced. Separation is prevented which occurs along the inner and outer walls at the trailing edge of the moving blades because of rapid shift of the flow line caused from the stepped portions each having the curvature R. To prevent the separation, the cross sectional center of gravity line of the moving blade 44 is shifted in the circumferential direction (by X and Y) from the radial line, as shown in FIG. 15. Thus, flows of the working fluid is pushed to the wall surfaces (flows n1 and n2) so that generation of local separation is prevented.

As a result, a similar effect to that obtainable from the second embodiment can be obtained.

Tenth Embodiment

Figure 16:
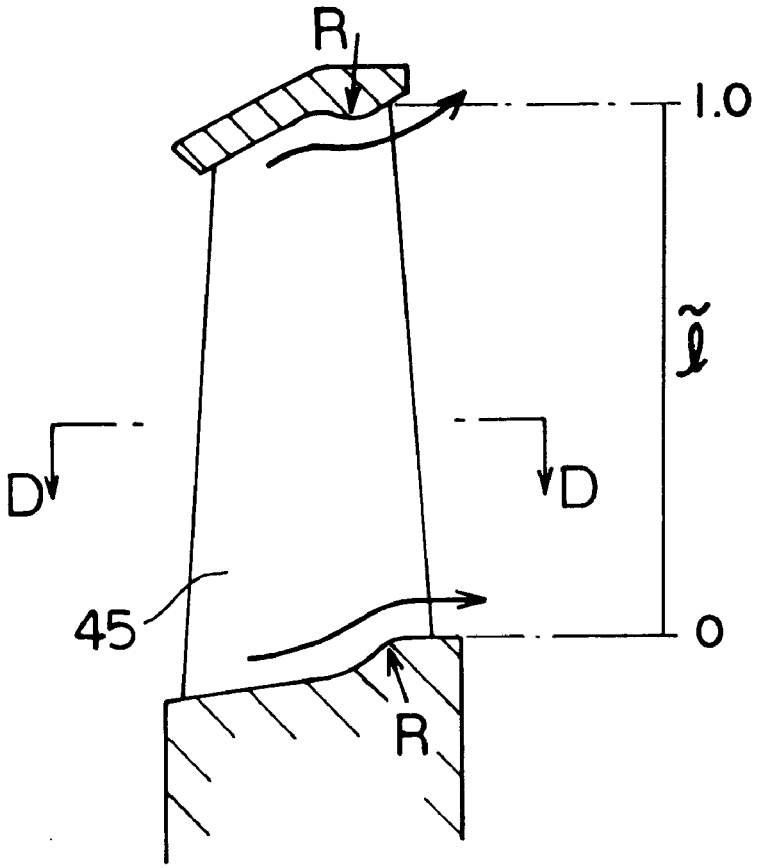
FIG. 16 is a cross sectional view showing a moving blade passage according to a tenth embodiment of a turbine blade of the axial-flow turbine according to the present invention.
Figure 17:
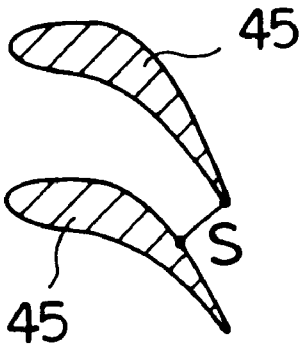
FIG. 17 is a cross sectional view taken along line D—D shown in FIG. 16.
Figure 18:
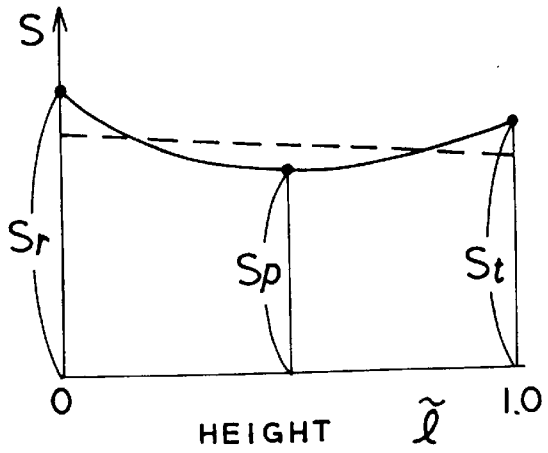
FIG. 18 is a graph showing dimensions of a throat between moving blades shown in FIG. 17.
Figure 19:
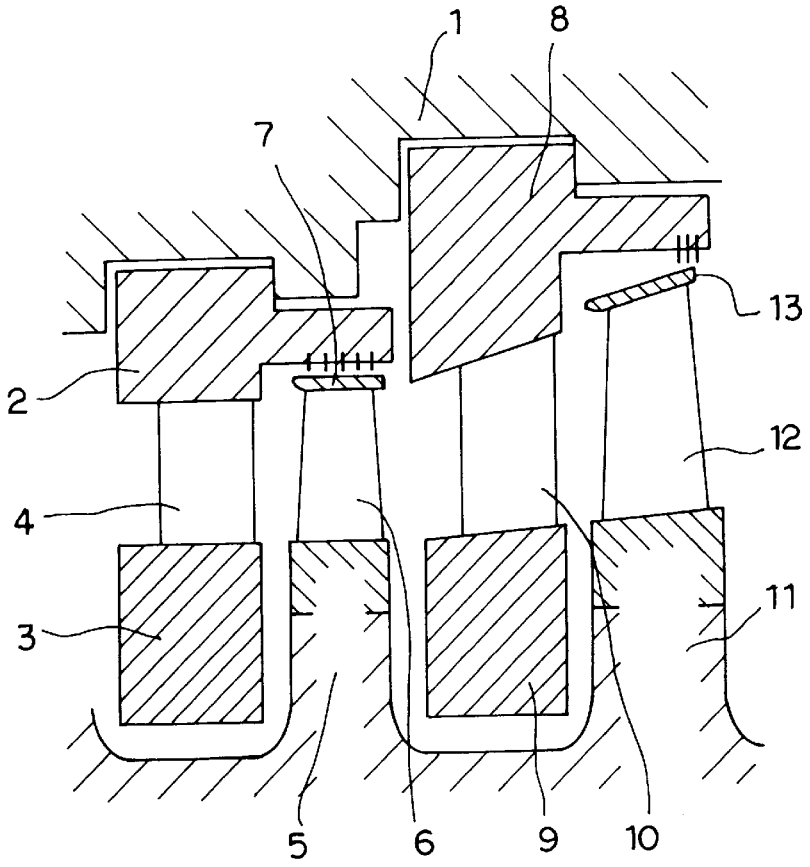
FIG 19 PRIOR ART
FIG. 19 is a cross sectional view showing a stage structure of the nozzle blades and moving blades of a conventional axial-flow turbine.
Figure 20:
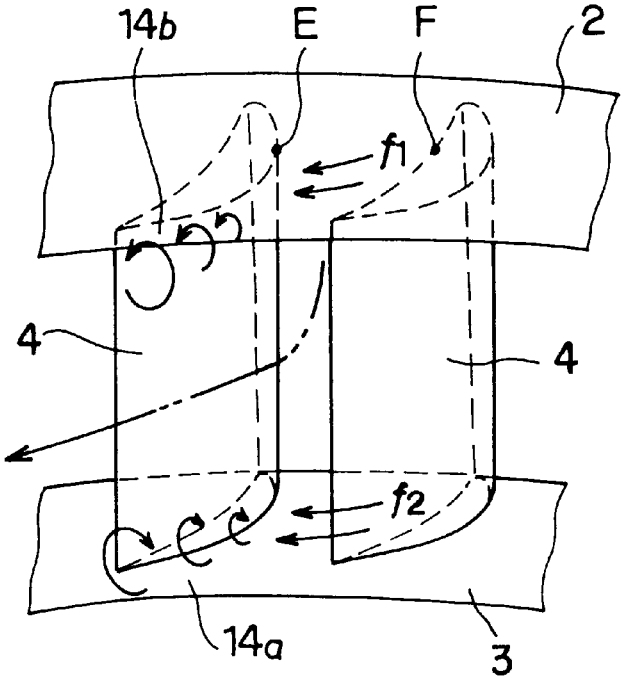
FIG. 20 PRIOR ART
FIG. 20 is a diagram showing a mechanism for generating a secondary flow between nozzle blades.
Figure 21:
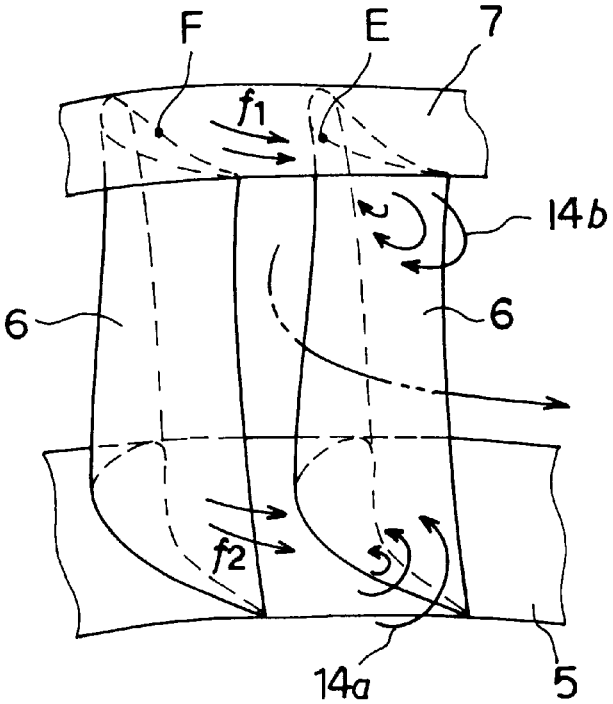
FIG. 21 PRIOR ART
FIG. 21 is a diagram showing a mechanism for generating a secondary flow between moving blades.
Figure 22:
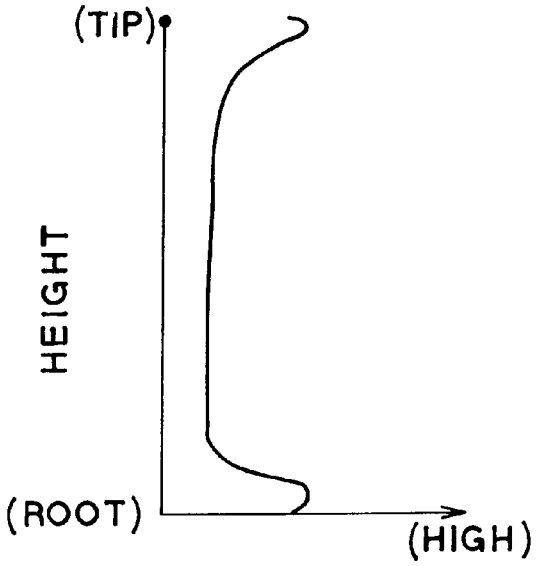
FIG. 22 PRIOR ART
FIG. 22 is a graph showing distribution of a secondary flow loss in the direction of the height of the nozzle blades.
Figure 23:
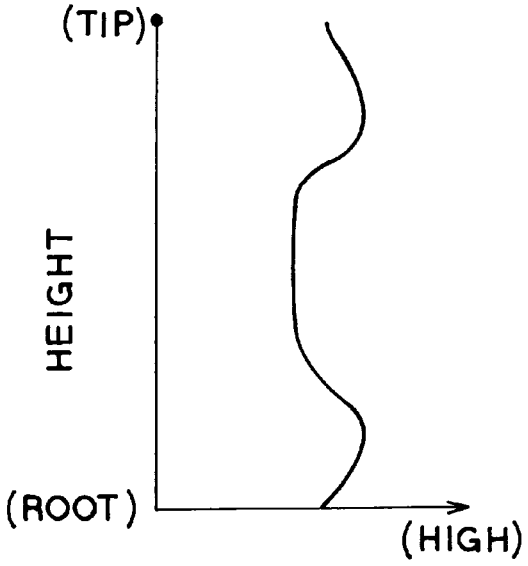
FIG. 23 PRIOR ART
FIG. 23 is a graph showing distribution of a secondary flow loss in the direction of the height of the moving blades.
Figure 24:
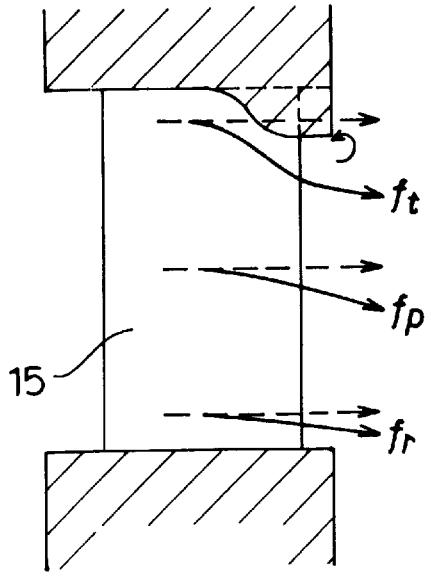
FIG. 24 PRIOR ART
FIG. 24 is a cross sectional view showing a conventional nozzle blade having a reduced outer surface.
Figure 25:
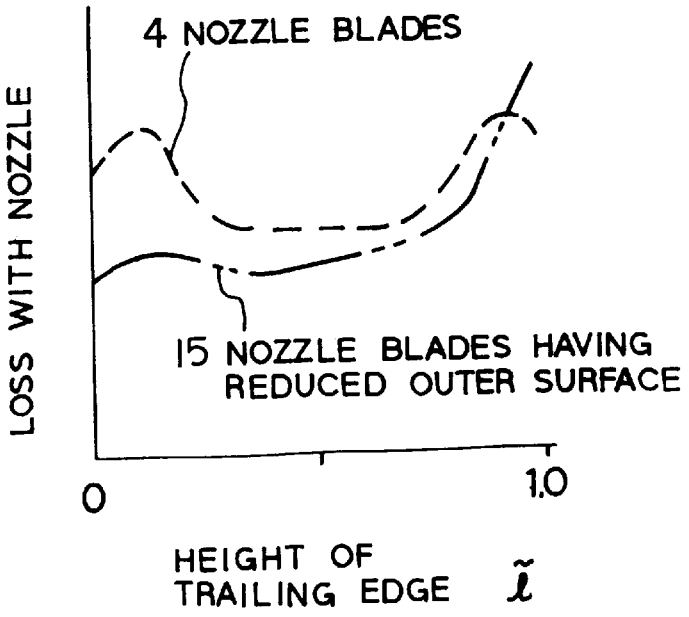
FIG. 25 PRIOR ART
FIG. 25 is a graph showing distribution of losses in the conventional nozzle blade passage.

FIGS. 16 to 18 are cross sectional views showing a moving blade passage according to a tenth embodiment of the present invention.

The moving blade passage according to the tenth embodiment has stepped portions formed on the inner and outer walls of the moving blades 45 and each having the curvature R. Thus, eddies in the secondary flow at the tip and the root of the moving blades 45 can be reduced.

Separation is prevented which occurs along the inner and outer walls at the trailing edge of the moving blades 45 because of a rapid shift of the flow lines at the stepped portions each having the curvature R. To prevent separation, the throat width (indicated with symbol S) between the moving blades 45 shown in FIG. 17 is determined to satisfy the following relationship as shown in FIG. 18:

$$Sr>Sp<St.$$

Since the above-mentioned distribution of throats is realized, the flow rates along the inner and outer walls of the moving blades 45 can be enlarged as compared with the conventional structure. Since the flow rate is controlled as described above, generation of local separation of flows along the inner and outer walls of the moving blades 45 can be prevented. Thus, a similar effect obtainable from the second embodiment can be obtained.

As described above, according to the present invention, stepped portions each having the curvature R are provided for the inner and outer walls of the nozzle blades and the moving blades. Moreover, the nozzle blade passage and the moving blade passage are formed in such a manner that the trailing edge of the nozzle blades and the moving blades are positioned in the most downstream positions in the central portions in the lengthwise directions of the blades. Thus, eddies in the secondary flow can be prevented and the distribution of flow rates of the working fluid can be uniformed.

The inner and outer walls of the nozzle blades and the moving blades are formed in such a manner that the nozzle blades and the moving blades are warped or the throats at the tip and the root between the nozzle blades and the moving blades are enlarged. As a result, the efficiencies of the turbine stages can be improved.

What is claimed is:

1. An axial-flow turbine comprising:

an outer diaphragm ring and an inner diaphragm ring forming together an annular fluid passage; and a plurality of nozzle blades disposed in the annular passage, each of the nozzle blades being formed into a warped shape such that a central portion in a lengthwise direction of the nozzle blade maximally projects in a downstream direction, wherein said annular fluid passage has a stepped portion at an inner surface of the outer diaphragm ring and an outer surface of the inner diaphragm ring, the stepped portion having a curvature surface so that the height of the fluid passage is reduced in a downstream direction thereof, and wherein said stepped portion has a height in a radial direction of the fluid passage, the height being described by the relationships:

$$0 \leqq h1/L1<0.05$$

$$0.1<h2/L1<0.2$$

where L1 is the height of a leading edge of the nozzle blades, h1 is the height of the stepped portion of the inner diaphragm ring and h2 is the height of the stepped portion of the outer diaphragm ring.

2. The axial-flow turbine according to claim 1, wherein each of the nozzle blades has an axial distance from the leading edge of the diaphragm to a trailing edge of the nozzle blades, the axial distance being described by the relationships:

$$Zt<Zr<Zp$$

where Zt is the axial distance at the outermost end of the nozzle blades, Zr is the axial distance at the innermost end of the same and Zp is the axial distance at the central portion of the same.

3. The axial-flow turbine according to claim 2, wherein each of the nozzle blades has a height L2 of the trailing edge thereof, the L2 being described by the relationship:

$$L1>L2$$

where L1 is the height of the leading edge of the nozzle blades.

* * * * *